US006615748B2

(12) United States Patent
Sunter et al.

(10) Patent No.: US 6,615,748 B2
(45) Date of Patent: Sep. 9, 2003

(54) GASIFIER

(75) Inventors: Richard Sunter, Malahat (CA); Jake Neufeld, Victoria (CA); David Wiles, Victoria (CA)

(73) Assignee: Malahat Systems Corporation, Victoria (CA)

( * ) Notice: Subject to any disclaimer, the term of this patent is extended or adjusted under 35 U.S.C. 154(b) by 0 days.

(21) Appl. No.: 09/978,692

(22) Filed: Oct. 18, 2001

(65) Prior Publication Data

US 2002/0046686 A1 Apr. 25, 2002

(51) Int. Cl.[7] ..... F23G 7/00; F23L 7/00

(52) U.S. Cl. ..... 110/233; 110/229; 110/248; 110/303; 110/306; 110/312; 110/297; 48/DIG. 8

(58) Field of Search ..... 110/215, 229, 110/233, 248, 297, 301, 302, 303, 306, 312, 313, 343, 345, 348; 48/197 A, 199 FM, 203, 197 FM, DIG. 8

(56) References Cited

PUBLICATIONS

Reed, T. B. and Das, A. Chapter 5: Gasifier Designs, Handbook of Biomass Downdraft Gasifier Engine Systems, Solar Energ Research Institiute, Golden Colorado, Document No. SERI/SP–271–3022, DE88001135, Mar. 1988, UC Category: 245, pp. 30 47.*

* cited by examiner

*Primary Examiner*—Ira S. Lazarus
*Assistant Examiner*—K. B. Rinehart
(74) *Attorney, Agent, or Firm*—Anthony R. Lambert

(57) ABSTRACT

A method and portable apparatus is described for the conversion of cellulose and other blomass waste materials through a pyrolysis and partial combustion sequence in a downdraft gasifier to produce a gas which can be immediately utilized to fuel an internal combustion engine in a generator set (genset). More specifically, the heat from the combustion of part of the cellulosic or other waste input is used to pyrolyze the remainder of the input to produce a mixture of permanent fuel gases. Particulates are removed (water scrubbers, filters) from the gas mixture which can then be used directly as a major part of the fuel to operate the internal combustion engine in the genset. All movement into, through, and out of the gasifier and purification train is controlled by the vacuum associated with the intake of the internal combustion engine, thereby ensuring a steady production of electricity.

23 Claims, 2 Drawing Sheets

GASIFIER

FIELD OF INVENTION

The present invention relates to a method and an apparatus for gasification of combustible material.

BACKGROUND OF THE INVENTION

A frequent problem encountered with the harvesting, re-fining or processing of organic matter is the accumulation of waste by-products. In particular, in forestry, the harvesting and primary and secondary processing of cellulose material results in the accumulation of large quantities of biomass such as slash, twigs, branches, bark, sawdust, trimmings and scrap. In agriculture, each crop cycle and primary processing leaves substantial biomass such as bagasse, corn cobs and rice hulls that cannot be otherwise utilized. The cost of disposing of such bio-mass, the environmental damage in disposing of such materials and the waste and lost value incurred in the failure to productively utilize such materials all constitute substantial problems. The historical practice of landfilling or open-incinerator burning such organic waste is unpopular for environmental reasons and in many instances contrary to present laws and regulations. Current environmental standards in many countries preclude the use of any burners except sophisticated incinerators to bum waste.

Single purpose incinerators are viewed as inefficient and wasteful of resources. Consequently, considerable activity has been directed at developing systems, procedures and apparatus to either clean burn organic waste materials or, preferably, to convert organic waste materials into a gas, as an alterative energy source, that can be used for other purposes. One approach is shown in U.S. Pat. No. 5,666,890. The need to create a portable gasification system is also stated in U.S. Pat. No. 4,530,702 although the problem is not addressed within that art.

Many existing gasification systems require drying of the biomass in order to reduce water content (Sawyer et al; German patent DE3505329; Frohlich & Kleineindam). It is preferable for gasification equipment to be able to process wood wastes having a high range of moisture contents (e.g., 15–60%) since this is the way it is found in its natural state. Several systems, such as that described in U.S. Pat. No. 4,530,702 require operation with pellets or chips, where the biomass is pre-manufactured for combustion. Other systems, such as that described in U.S. Pat. No. 5,666,890 require a basic pre-processing of the biomass through particle size reduction in order to achieve a satisfactory conversion process. In addition to adding to the expense and the complexity of the system, these steps or requirements are often impractical for the efficient disposal of waste. It is preferred to operate a system that accepts and operates efficiently with biomass in its natural form regardless of the variance in water content without pre-processing or other additional preparation steps.

Gasification devices have been described in prior art which are suitable for individual mill or plantation operations. For example, U.S. Pat. No. 5,226,927 discloses a vertical axis, updraft reactor in which the partial oxidation of wood material is used to heat the remaining wood to a temperature of 2700 degrees Fahrenheit to produce synthesis gas—a mixture of carbon monoxide, hydrogen and methane. Similarly, U.S. Pat. No. 4,764,185 teaches the utility of a similar device in which the gases are moved through the system by fan or blower. In U.S. Pat. No. 4,309,195 it is disclosed that the producer gas (essentially the same as synthesis gas) formed from solid organic fuel in a gasifier apparatus is lead from the cooler/cleaner using a blower, and it is suggested that it can be used directly as a substitute for natural gas or used as a fuel for diesel or gasoline engines. A French patent (FR 2497819) discloses a gas generator which can burn damp wood or maize cobs to produce gas for use in diesel or petrol engines. Likewise, a German patent (DE 3505429) discloses a method of converting dried (15–20% moisture content) chopped wood into gas which, after cooling and scrubbing, is fed to a gas engine coupled to a generator.

In addition to the patents referred to above, there are several publications that describe devices for generating gases from cellulose waste, and for fueling an internal combustion engine which powers a generator.

Various problems are associated with all of the existing cellulose pyrolysis devices, with particular problems characteristic or specific designs. Other gasification equipment requires intricate mechanical devices to prevent bridging of the input material (e.g., U.S. Pat. No. 5,226,927; Rundstrom) but such devices consume energy, require maintenance and are not necessarily effective with all types of feedstock, for example stringy bark.

In some types of gasification equipment, the partial pyrolysis of cellulose or other hydrocarbon material results in the formation of breakdown products which are gaseous at the elevated temperature in or near the gasification zone but which condense in pipes, valves and chambers at lower temperatures, for example, at ambient temperature. Such complications occur with gasification equipment, for example, which operates in an updraft mode, that is in which pyrolysis product gases are removed from the top of the vessel.

The nominal mineral (ash) content of wood cellulose is in the 1 to 2% range but there is, in addition, the probability of the inadvertent inclusion of foreign materials, e.g., stones, nails owing to the conventional methods of handling large quantities of waste materials. Equipment used in the gasification of cellulosic waste must be able to handle such mineral contaminants with provision for removal from the pyrolysis enclosure and quenching to ambient temperature. U.S. Pat. No. 5,226,927 describes an elaborate movable, (reciprocating) grate device which could be rendered inoperative with certain sizes of inorganic materials and which, in any event, does not provide for the quenching of the ash.

It is necessary to ensure the continuous flow of gases—air into the gasifier and a mixture of fuel gases, combustion products and nitrogen—down through the gasifier and on into adjacent pipes and/or chambers. Much of the prior art does not address this issue at all. In some cases, however, the use of a motor driven fan at the gasifier outlet is specified (e.g., U.S. Pat. No. 4,764,185 Mayer; U.S. Pat. No. 4,309,195 Rotter). In addition, to the extra costs of operating and maintaining such a blower, it can result in the removal by suction of excessive amounts of fine particles (ash, carbon) from the gasification chamber causing serious contamination problems downstream.

SUMMARY OF THE INVENTION

Accordingly, it is an object of the present invention to provide a method and apparatus for converting organic waste to usable fuel gas which is portable, which uses fewer mechanical parts and less maintenance demands than existing systems, which operates in an environmentally secure manner and which is self sustaining and, after startup, fuels itself.

It is a further object of the present invention to provide a method and apparatus that efficiently converts biomass to usable gas without the need to dry or pre-process the feedstock and which utilizes the water inherent in most biomass as part of the pyrolysis procedure regardless of the variance in quantity.

It is an additional object of the present invention to provide an efficient means by which ash is removed from the burn chamber without interruption in the bum/pyrolysis processes, and an efficient means by which the synthesis gas is removed from the gasifier without mechanical moving parts such as a blower or a fan.

Therefore, according to a first aspect of the invention, there is provided a gasifier comprising a feed hopper, a burn chamber disposed to receive feed material from the feed hopper, a gas supply operably connected to the burn chamber for supplying gas containing oxygen to the burn chamber, a water supply operably connected to the burn chamber for supplying water to the burn chamber and a burn chamber outlet conduit in the burn chamber for egress of gases produced within the burn chamber by reaction of pyrolysis products according to the water gas.

According to a further aspect of the invention, an evacuator, for example an internal combustion engine, has an intake operably connected to the burn chamber outlet conduit for drawing gas along a flow path from the burn chamber into the evacuator.

According to a further aspect of the invention, particulate removal apparatus is provided in the flow path between the intake and burn chamber outlet conduit. Preferably, the particulate removal apparatus is selected from the group consisting of scrubbers and filters.

According to a further aspect of the invention, the burn chamber is formed of an upper chamber and a lower chamber below the upper chamber, the upper chamber is separated from the lower chamber by a hinged plate; and the hinged plate is operable upon hinging to transfer feed material under force of gravity from the upper chamber into the lower chamber.

According to a further aspect of the invention, flow of gas towards the evacuator defines a downstream direction, and the burn chamber is defined by an encircling wall, the gasifier further comprising a grate within the burn chamber situated downstream from gas supply and the water supply, the grate comprising plates forming a support for a coal bed during operation of the gasifier.

According to a further aspect of the invention, reciprocating angled plates are interleaved with the plates of the grate, the reciprocating angled plates being arranged to reciprocate parallel to the downstream direction and cause debris on the grate to move towards the encircling wall.

According to a further aspect of the invention, there are provided ports in the encircling wall adjacent the grate for the removal of debris from the burn chamber.

According to a further aspect of the invention, the water supply is a source of steam, which may be a coiled pipe encircling the burn chamber.

According to a further aspect of the invention, the gas supply is connected to a source of heated air.

According to a further aspect of the invention, the egress of gases from the burn chamber follows a flow path passing above a water reservoir. Preferably, the burn chamber is bounded on one side by water in the water reservoir. Preferably, the burn chamber outlet conduit comprises a pipe having an opening for entry of gas into the pipe, the opening being on a side of the pipe that faces the water in the water reservoir.

According to a further aspect of the invention, there is provided a method of gasifying feed material by feeding feed material into a burn chamber, burning the feed material in the burn chamber in the presence of water to generate sufficient heat to pyrolyze the feed material and produce gas by the water gas reaction; and drawing the gas from the burn chamber.

Drawing of the gas from the burn chamber may be carried out by operation of an internal combustion engine, the intake of which is connected to the burn chamber.

Drawing gas from the burn chamber may be carried out by passing the gas through a particular removal apparatus, which preferably is formed by a scrubber followed by a dry filter. Preferably, the gas is drawn over a water reservoir. Material flow into the burn chamber is through a feed material inlet and an air supply.

Preferably, the burn chamber comprises a grate, and the temperature at the grate is maintained at a temperature of about 1800 degrees F. to 2200 degrees F. by controlled injection of water and oxygenated gas.

These and other features of the invention are described in the detailed description of the invention and claimed in the claims that follow.

BRIEF DESCRIPTION OF THE DRAWINGS

These will now be described preferred embodiments of the invention, with reference to the drawings, by way of example only and without intending to limit the generality of the invention, in which like reference characters denote like elements and in which.

DETAILED DESCRIPTION OF THE PREFERRED EMBODIMENT

In this patent document, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

Figure 1:
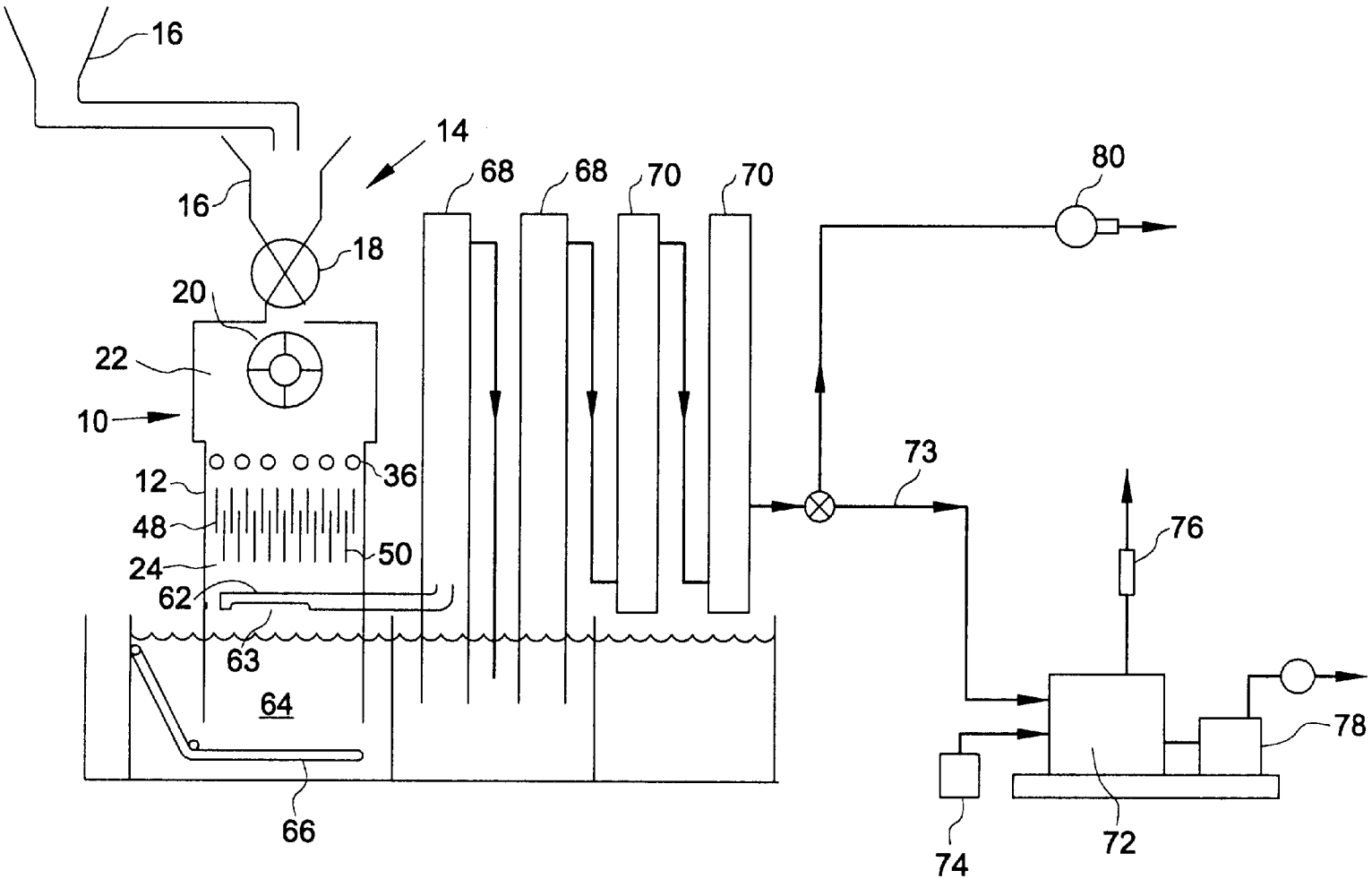
FIG. 1 is a side view schematic of an embodiment of the invention.
Figure 2:
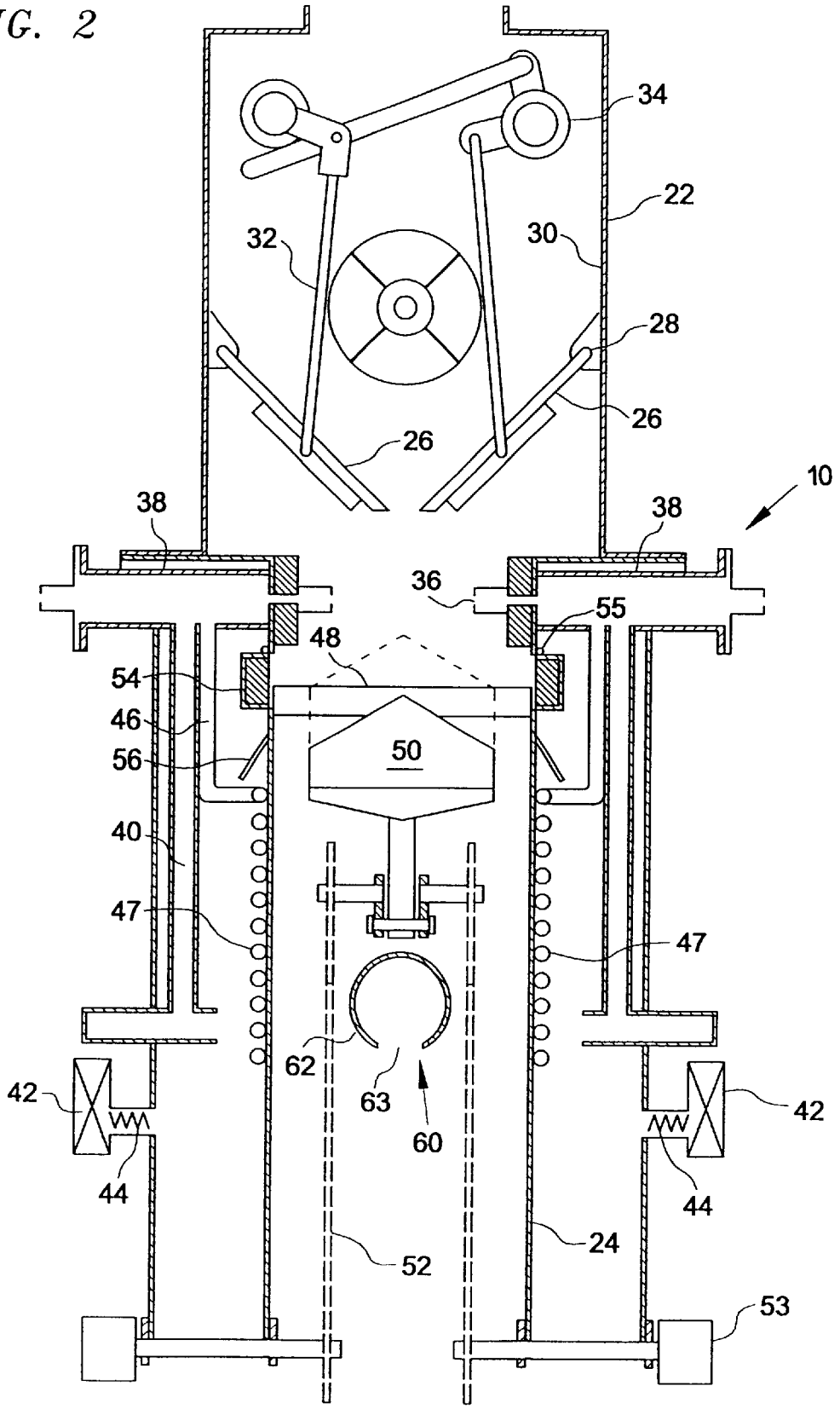
FIG. 2 is a section through a pyrolysis and combustion chamber according to the invention.

Referring to FIGS. 1 and 2, there is shown a vertical axis wood gasifier 10 formed from an encircling wall 12 which is lined with ceramic material in conventional manner. A feed entry port 14 comprises a set of feed hoppers 16 through which feed material is supplied to a conventional rotary air lock 18. The rotary air lock 18 has six rotating rubber paddles, not shown, attached to metal flame. Material drops from the top between the spokes, rotates counterclockwise and falls out at the bottom. The paddles maintain an airtight environment in the gasifier 10. An electric motor, not shown, and a speed reducer, not shown, drive the air lock at a desired rate. The speed is constant, and like all other features of the gasifier, is preferably oversized for the operation. The air lock 18 supplies feed material to an auger 20 disposed in an upper pyrolyzing chamber 22 of the gasifier 10. The auger 20 distributes feed material within the upper chamber 22. The feed material may comprise wood waste (or other organic matter) and is loaded by conventional means into the first of the feed hoppers 16. The rotary airlock 18 is turned in order to transfer feed material into the top of the gasifier chamber at a rate required to maintain somewhere between a one and two foot depth of solid feedstock at the top of the gasifier. The auger 20 is formed of a spiral section directly under the air lock 18 and a section with paddles for flailing material within the upper chamber 22 to distribute it within the chamber 22. The flow of raw material into the gasifier is determined by the rate at which the material falls in the chamber 24 and is consumed by the use of heat and/or converted to gas with only ash remaining. The level of the material in the upper chamber is the control parameter. A monitoring device senses the current draw or load on the auger, and when this falls below a certain rate, additional feed material is introduced into the upper chamber 24. When the load is too great, no further feed material is added.

The upper chamber 22 is separated from a lower burn chamber 24 of the gasifier 10 by a pair of carborizer plates 26, of which preferably one, though possibly both, are hinged at hinges 28 to the interior wall 30 of the upper chamber 22. The plates 26 meet in the center bottom of the upper chamber 22 and are preferably made of high temperature stainless steel. The plates 26 are preferably at an angle of about 55 degrees to the horizontal. The upper chamber 22 is heated by radiant and conducted heat from burning in the lower chamber 24. Feed material in the upper chamber 22 is at least partially pyrolyzed in the upper chamber 22 by heat radiating and conducting upward from the plates 26.

The plates 26 are periodically lowered by a set of link arms 32 connected to drive wheels 34. The drive wheels 34 are powered by an electric motor, not shown. The arrangement and periodic movement of the plates 26 in the upper chamber prevent formation of bridges of feedstock and allow partially pyrolyzed feed material to drop under force of gravity into the lower burn chamber. Typically, the plates 26 are lowered at intervals in the order of three minutes.

Below the upper, pyrolyzing chamber 22 is the lower, burn chamber 24 where combustion of material takes place. The feed material entering the burn chamber 24 carries with it some air, but additional air is usually required to generate enough heat to fully decompose the feed material by pyrolysis. Air is metered into the chamber from an air supply through nozzles 36, for example 1.5 inch ceramic tuyeres, at a rate necessary to bum part of the feedstock and keep the temperature in the middle (pyrolysis) zone of the gasifier in the 1400 to 1700° Fahrenheit range. The tuyere nozzles 36 form an array along each of two sides of the burn chamber 24. As many nozzles 36 should be provided as required, and there may be more than one row of nozzles 36. The nozzles 36 communicate with an air manifold 38, which is supplied air from a tube 40 that runs outside and parallel to the burn chamber 24 in a position where air in the tube 40 is heated by radiant heat from the burn chamber 24. This pre-heats the air entering the manifold 38. Air supply into the manifold 38 is controlled by a valve 42. An additional electric heater 44, for example 3 kW, may be provided in the air supply ducts for additional preheating of the air and raising the temperature of the air to initiate ignition in the burn chamber 24. The electrical heaters 44 may be located in each air pipe that is connected to the nozzles 36 surrounding the fire chamber. Preferably, there will be multiple such nozzles 36, for example twelve, to provide for an even start up during ignition of the material in the burn chamber.

A water supply is also provided in the form of steam, which is added to the air in the air manifold 38 by pipes 46. The pipes 46, for example ¼ inch copper, are preferably wound in a coil 47 around the burn chamber 24 so that water pumped into the pipes 46 by a pump, not shown, is heated into steam before it enters the manifold 38. The water, in the form of steam, is carried in through the manifold 38 and injected as steam through the nozzles 36 so as to cause the water-gas and related reactions to occur. This optimizes fuel gas formation.

Below the nozzles 36 is a grate 48. The grate 48 is formed of thin bars running the width of the burn chamber 24. For example, 100 3 inch×⅜ inch 304 SS bars separated from each other by 2 inches may be used. During operation, a 4 inch to 8 inch bed of red hot coals forms on the grate 48. It is desirable to maintain the bed of coals at this thickness. The plates of the grate 48 are interleaved with a set of jumper plates 50. The jumper plates 50 are driven by a drive chain 52 powered by a motor 53 that reciprocates the plates 50 up and down from about level with the top of the grate 48 to above the grate 48. The jumper plates 50 are angled, preferably tapering on both sides as shown. Operation of the jumper plates 50 cleans the grate 48 and expels trash from the gasifier. Adjacent the jumper plates 50 at the sides of the burn chamber 24, just above the top of the grate 48, are ports formed of hinged insulated doors 54 of conventional construction. The doors 54 pivot on horizontal hinges 55. As material accumulates on the grate 48, it may be spread to the sides and out of the doors 54, by operation of the jumper plates 50, where it drops down outside of the bum chamber 24 Angled deflector plates 56 protect the water coil 47 from the debris falling out through the doors 54.

Temperature in the burn chamber 24 is monitored by a thermocouple, not shown. An undesirable increase in temperate may be countered by adding steam and/or reducing air flow, thus cooling the burn chamber 24. An undesirable decrease in temperature may be countered by adding air and/or decreasing steam. A programmable logic computer (PLC) may be used to control the plant functions in accordance with this description. The temperature is maintained at a level at which the water gas reaction occurs.

Below the grate 48 is a burn chamber outlet conduit 60, which is formed of a pipe 62 having an opening 63 on one side of the pipe facing away from the combustion zone of the burn chamber 24. Below the pipe 62 is a water reservoir 64. The pipe 62 is arranged with the opening 63 facing the water reservoir so that gas moving out of the burn chamber 24 deflects off the water in the water reservoir and into the pipe 62. This provides immediate cooling of the gas to prevent formation of deleterious compounds. A conveyor 66 removes debris that falls into the water. Gas drawn through the burn chamber 24 exits through the pipe 62 and into a set of scrubbers 68 and dry air filters 70, which form particulate removal apparatus. The scrubbers 68 use conventional water flow to flush particulates from the gas stream being drawn from the gasifier 24, and are conveniently situated in the same water reservoir 64. For both the furnace and the scrubbers, the water reservoir both cools the gases and provides explosion relief.

Gas is drawn from the burn chamber 24 by operation of an evacuator, for example an internal combustion engine 72, which in turn may be a diesel engine. Other evacuators may be used, for example a blower connected to the conduit 73, blowing away from the burn chamber 24. In the example shown, the gas provides fuel to the engine 72 and is drawn into the air intake manifold of the engine 72 through conduit 73. The engine 72 obtains conventional fuel from a fuel tank 74 and is provided with an exhaust system 76. The engine 72 may be used to operate an electric generator 78, power from which may be used in the operation of the gasifier. The engine 72 is provided with a vacuum regulator to maintain a constant vacuum at the air intake manifold to enable a constant negative pressure on the burn chamber 24.

The gasifier is preferably operated so that the area below the pyrolysis region of the gasifier chamber, between the nozzles 36 and the grate 48, is a hot zone where the temperature is in the range of 1800 to 2200° Fahrenheit. By maintaining this temperature range, all remaining hydrocarbons in the partially pyrolyzed feed material are converted to permanent fuel gases.

Mineral matter in the feed material, including contaminants loaded in to the hopper with the feedstock, fall through the grate 48, are quenched in and collect at the bottom of the water reservoir 64 below the gasifier 10. This ash can be removed periodically with the conveyor 66, of other conventional mechanical device, and disposed of in a landfill, for example. The mixture of fuel gases produced by the gasifier 10, i.e., the synthesis gas, flows from the bottom of the gasifier 10 through the horizontal pipe 62 to the bottom of the water scrubber 68, then upwards in each scrubber 68 over high surface area conventional, inert packing (Q-PAC™, eg as available from Harrington Environmental of San Bernardino, Calif.) through a water spray. As many scrubbers 68 should be used as are needed to clean the gas. The water from the spray is pumped up from the water tank 64, filtered, and pumped through a spray head at the top of the scrubber column down through which it returns over the packing surfaces to the tank below. Any particulates entrained in the fuel gas stream coming from the bottom of the gasifier 10 are thereby removed and collected at the bottom of the water tank 64 which is below the scrubbers 68. The cleaned and cooled fuel gas is piped from near the top of the second scrubber 68 through two dry filter tubes 70 in series. The dry filters 70 contain conventional filtration materials such as 2 inch fiber glass insulation, in one section with the external wrap tube taken off, and in another section wrapped in natural felt. Felt is desirable for use in removing any ash particulates and/or tar that have not been removed in the scrubbers.

The engine operates such that conventional fuel is used at a consumption rate about 5–20% of the normal requirements with the remainder of the fuel being supplied by synthesis gas being drawn from the filter train. Whenever the supply of synthetic gas is restricted by for example unusually wet feedstock, the engine 72 will be able automatically to draw more conventional liquid fuel. This feature ensures the rpm's of the engine and therefore the electrical power output of the generator 78 will remain essentially constant. The diesel's own governor regulates its speed. The gas from the gasifier 10 is connected directly into the air intake manifold of the engine 72. Since the engine's intake manifold vacuum and the gasifier's required vacuum are never synchronized or equal, a shutter is attached to the gas/vacuum line from the gasifier, which is operated by a counterweight or spring. Once adjusted, the shutter will maintain the vacuum (about 6 inches to 8 inches) on the gasifier at a steady state.

Optionally, the synthesis gas may be used as a direct substitute for natural gas or propane as a source of heat. In that case, it is convenient to pull the synthesis gas off after the filter tubes using a blower fan or similar device 80 connected to the gas conduit 73 at a valve. The gas can be piped to kiln burners, water heaters and the like.

It is preferred to control the pyrolysis process such that only permanent gases (non-condensable down to liquid nitrogen temperature) are formed. In allowing for combustion of part of the feedstock to produce the heat need to pyrolyze the remainder of the feedstock, some solid carbon (char, particulates) will form and will remain in the interior of the gasifier chamber 24. The preferred way of dealing with this situation is to admit enough water into the manifold 38 to promote the water-gas reaction. This is not a single simple reaction but a series of equilibria, which favour gaseous product at temperatures above about 1800 degrees Fahrenheit. One can describe the chemistry taking place as:

$$C+CO_2 \longleftrightarrow 2CO$$

$$CO+H_2O \longleftrightarrow CO_2+H_2$$

$$C+H_2O \longleftrightarrow CO+H_2$$

$$C+2H_2 \longleftrightarrow CH_4$$

A description of the water gas reaction is contained in U.S. Pat. No. 5,226,927 (Rundstrom) and U.S. Pat. No. 4,309,195 (Rotter). All four endothermic processes produce useful, permanent fuel gases, and it is believed to be essential that they occur in order to have the most efficient efficient gasification process.

The production of a mixture of permanent, combustible gases (synthesis gas or producer gas) from wood waste and from analogous surplus organic materials can provide a useful alternative to fossil fuels. For example, burning synthesis gas to dry lumber, heat water, and improve the combustion of other wastes is certainly worthwhile economically. However, it is more useful to use such gas as substitute fuel for an internal combustion engine that is used to generate electricity. Prior art (U.S. Pat. No. 4,309,195 Rotter; French patent FR 2497819) suggests that this can be done, although how to do so is not described.

In operation, the feed material, which may be wood waste (or similar organic wastes), having a wide range of moisture contents, is fed through a rotary airlock at the top of the vertical axis, down-flow gasifier 10. The interior design, with movable plates 26, below the airlock, precludes feedstock bridging. In the combustion zone, part of the feedstock is oxidized (burned) at a high temperature using, in part, air brought in with the feed, but more particularly air metered in through the nozzles 36 arranged around the interior of the burn chamber 24. The heat produced in this way pyrolyzes (thermally breaks down) the relatively large molecules in the remainder of the incoming waste material into very much smaller molecules at temperatures in the range of 1800 to 2200° Fahrenheit. The combination of partial oxidation/partial pyrolysis is completely self-sustaining (in a temperature sense) within minutes of start-up. The pyrolysis products together with the combustion products are drawn down the gasifier through an oxygen-free (reduction) zone, which is at a temperature of up to 2800° Fahrenheit, the hot zone.

Small amounts of water are introduced to convert (among other processes) solid carbon (char) produced in the pyrolysis procedure into the permanent gases carbon monoxide and hydrogen (water-gas reaction). A combination of this reaction, and the high temperature in the hot zone ensures that the only combustibles leaving the gasifier are the permanent gases characteristic of synthesis gas (or producer gas) i.e., carbon monoxide, hydrogen and some methane. There is nothing to condense out downstream at ambient temperature. The fuel gases are not condensable at the temperature of dry ice.

The vertical-axis, downward-flow gasifier 10, and the water-scrubber portions of the purification train are each suspended above separate compartments of the water tank 64, with the open lower ends of each of these vessels projecting downward below the surface of the water in these compartments. This design geometry provides a pressuresurge safety device in what is essentially a closed system between the air-lock above the gasifier and the fuel intake of the internal combustion engine. However, it also permits the maintenance of a partial vacuum throughout the entire system, as well as providing a quenching and collection function for ash and other inorganic particulates.

Situations may arise when in an effort to increase the throughput of the gasifier 10, waste organic material will be fed at a faster rate through the airlock 18. It may then become necessary to add more air through the nozzles 36 into the gasifier 10 in order to maintain a sufficiently high temperature in the hot zone. Depending on the water content of the feedstock, a build up of char may occur, and this in turn may require the introduction of additional water through these same nozzles 36, which can, under some circumstances, lower the temperature excessively at the grate 48. Accordingly, a second set of nozzles 36 may be affixed circumferentially around the inside of the gasifier 10 about 5 inches below the first set. Air may be metered through this lower set independently of the injection of air and/or water through the upper set. This de-coupling of air and water injection may be used to maintain temperatures at the grate in the 1800 to 2200° Fahrenheit at maximum throughput rates regardless of the water content of the feedstock, while ensuring that only permanent gases exit the gasifier 10 and no significant amount of char is permitted to form.

EXAMPLE

In accordance with one embodiment of the invention, the equipment has been operated as follows:

Stage 1—Approximately 650 pounds of mixed wood waste (bark, sawdust, shavings, chips, excelsior and white wood ends) was loaded into the hopper above the rotary air lock. The moisture content of the waste constituents varied from about 30% for the wood shaving to about 60% for the bark and sawdust. Most of the initial charge was introduced to the top of the gasifier through the rotary airlock before the system was started. Wood waste in the hopper above the airlock was periodically replaced during the gasifier operation, and the supply at the top of the gasifier (below the airlock) was controlled during operation by a level sensor connected to the motor operating the airlock.

Stage 2 The diesel engine was started up using only conventional diesel fuel, and three 4500 watt heating elements (in a 500 gallon water tank) were turned on to provide for a load for the generator being driven by the engine. The air intake for the diesel, connected to the gasifier (through the filters and scrubbers) with a 6 inch pipe, was opened fully to create a partial vacuum (3" water column) inside the gasifier.

The water pump for the water scrubbers was turned on. The valve into the tuyere system was opened approximately ½", and the water metering pump that supplies clean water to the tuyere intake was started.

Stage 3 Two 2" valves, located just below the grate in the outer wall of the gasifier, were opened wide, and a plumbers torch was inserted through one of them to ignite the wood waste. As the waste material started to bum, the two valves were closed. As the temperature inside the gasifier began to climb, the water being injected through the tuyere turned to steam, and the fuel gas produced in the gasifier reduced the amount of conventional liquid diesel required by the engine, as indicated in the flow meter in the liquid fuel line.

Stage 4 The production of synthesis gas climbed steadily and rapidly after ignition, reaching a value of 60 to 90% of the fuel required to drive the genset. The variable fuel gas production rate is a result of the variability in the size, moisture content, and material type being fed into the gasifier. Periodically, in order to maximize the throughput of wood waste and the production of fuel gas, the carburizer plates were moved to prevent "bridging" at the top of the gasifier, and the jumper plates were raised and lowered a number of times to prevent build-up of ash on the grate.

The gasifier has been operated in this manner on numerous occasions, usually for a 6 to 10 hour period of time. The level of the water bath rose slightly over a period of 3 to 5 days of running time. Since a small amount of creosote was formed during each start-up period, it was periodically filtered out of the top of the water bath and recycled (together with the paper filter) through the gasifier. After several months of operation, three 5 gallon pails of material were collected from the bottom of the water tank, underneath the gasifier. It consisted of ash and small pebbles.

The fuel gases provide up to 90% of the fuel requirements of the engine which, however, draws upon a supply of conventional diesel fuel to ensure "dieseling", constant rpm in spite of variable feedstock, and start-up capability. The diesel engine thereby produces a constant output of electrical energy by driving a generator.

The flow of gases into, through and out of the gasifier, through the scrubber and filters is caused and controlled by a normal vacuum (suck) associated with the intake manifold of the diesel engine which is part of the genset. In this embodiment, there are no blowers or fans to consume energy, require maintenance, or blow fine particles around the equipment.

The entire train of equipment operates under a small, partial vacuum of about 6–8" of water. This precludes any leakage of gases into the environment and avoids any problems (including regulatory) which such leaks could give rise to.

The gasifier and the water scrubbers are supported with their open lower ends submerged in a section of a divided tank of water. The design feature provides for: (i) quenching and recovery of inorganic material (ash) from below the bottom of the gasifier; (ii) a safety/pressure release function to cope with inadvertent pressure surges in what is essentially a closed system between feedstock air lock and diesel exhaust stack; (iii) a collection device for "creosote" type material which can form during the few minutes required for warm-up of the gasifier (after start-up). The creosote floats in the water and is easily recovered for reintroduction into the gasifier; (iv) a source of water for the scrubber; (v) a medium having a high heat capacity which helps cool the fuel gases.

The cross-section of the pipe, below the grates (at the bottom of the gasifier) but above the water surface, is such that the fuel gasses acquire a swirling motion as they are collected and fed to the bottom of the water scrubber. This cyclone effect serves to disentrain most of the particulate matter, such that these solids fall into the water bath below.

Preferably, the gasifier is provided with an automatic ignition system which, when activated, uses the electrical elements in the air supply to heat the air entering the gasifier chamber through the tuyeres. After the ignition temperature of the volatile combustible gases (driven off the wood waste) is reached, self-perpetuating combustion of a portion of the wood occurs and the heaters in the air supply tubes shut down automatically. They are reactivated automatically if, for any reason, the temperature in the gasifier drops below a pre-set value. The portion of the wood waste that is burned is controlled by controlling the air supply.

There are only four inputs to the entire line-up of equipment: (a) waste wood or other unwanted organic material as feedstock; (b) diesel fuel to provide start-up and auxiliary fuel for the diesel engine; (c) a minor amount of electricity to operate water pumps and conveyance devices; (d) water to fill the tank initially. It has been found that there is a rough balance during prolonged operation between water introduced with the feed stock and water produced by combustion on the one hand, and water consumed in the gasifier and lost by evaporation on the other hand.

There are only two outputs for the entire operation: (a) particulates from the ash outlet and the scrubber residues; (b) exhaust from the diesel engine if the fuel gas is fed to that engine, or conventional combustion products if the gas is used in a burner as a replacement for natural gas. This ensures easy compliance with environmental regulations.

No char or tar-like materials should be allowed to exist in the gasifier chamber since this would contaminate the gas purification issue and the fuel gas itself The present invention precludes this problem by forcing all existing materials to pass through the heat zone after the completion of the water-gas reaction.

It will be apparent to one skilled in the art that the present invention provides a method and apparatus for converting organic waste to usable fuel gas which is comparatively portable, which uses fewer mechanical parts and less maintenance demands than existing systems, which operates in an environmentally secure manner and which is self sustaining and, after start-up, fuels itself. It will also be apparent to one skilled in the art that the present invention provides a method and apparatus that efficiently converts biomass to usable gas without the need to dry or pre-process the feedstock and which utilizes the water inherent in most biomass as part of the pyrolysis procedure regardless of the variance in quantity. It will further be apparent to one skilled in the art that the present invention provides an efficient means by which char and ash is removed from the bum chamber without interuption in the burn process and an efficent means by which the synthetic gas is removed from the burn chamber without mechanical moving parts such as a blower or a fan. It will finally be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A gasifier, comprising:

a feed hopper;

a burn chamber disposed to receive feed material from the feed hopper;

a gas supply operably connected to the burn chamber for supplying gas containing oxygen to the burn chamber;

a water supply operably connected to the burn chamber for supplying water to the burn chamber;

a burn chamber outlet conduit in the burn chamber for egress of gas produced within the burn chamber by reaction of pyrolysis products to produce fuel gases;

an evacuator connected to the burn chamber outlet conduit for drawing gas from the burn chamber along a flow path above a water reservoir; and the burn chamber outlet conduit comprising a pipe having an opening for entry of gas into the pipe, the opening being on a side of the pipe that faces the water in the water reservoir.

2. A gasifier, comprising:

a feed hopper;

a burn chamber disposed to receive feed material from the feed hopper;

the burn chamber being formed of an upper chamber and a lower chamber below the upper chamber;

the upper chamber being positioned to be heated by burning in the lower chamber, whereby material in the upper chamber is partially decomposed by pyrolysis;

a gas supply operably connected to the lower chamber for supplying gas containing oxygen to the burn chamber;

a water supply operably connected to the lower chamber for supplying water to the burn chamber;

a burn chamber outlet conduit in the lower chamber for egress of gases produced within the burn chamber by reaction of pyrolysis products to produce fuel gases; and the upper chamber being separated from the lower chamber by a hinged plate.

3. The gasifier of claim 2 in which the hinged plate is operable upon hinging to transfer feed material under force of gravity from the upper chamber into the lower chamber.

4. The gasifier of claim 2 in which flow of gas towards the burn chamber outlet conduit defines a downstream direction, and the burn chamber is defined by an encircling wall, the gasifier further comprising:

a grate within the lower chamber situated downstream from gas supply and the water supply, the grate comprising plates forming a support for a coal bed during operation of the gasifier.

5. A gasifier, comprising:

a feed hopper;

a burn chamber disposed to receive feed material from the feed hopper, the burn chamber having a combustion zone;

a gas supply operably connected to the burn chamber for supplying gas containing oxygen to the burn chamber;

a water supply operably connected to the bum chamber for supplying water to the burn chamber;

a burn chamber outlet conduit in the burn chamber below the combustion zone for egress of gas produced within die burn chamber by reaction of pyrolysis products to produce fuel gases;

an evacuator connected to the burn chamber outlet conduit for drawing gas from the burn chamber along a flow path;

flow of gas towards the evacuator defining a downstream direction, and the burn chamber being defined bit an encircling wall; and a grate within the burn chamber situated downstream from the gas supply and the water supply, the grate comprising plates forming a support for a coal bed during operation of the gasifier.

6. The gasifier of claim 1 in which the evacuator comprises an internal combustion engine having an intake operably connected to the burn chamber outlet conduit for drawing gas along a flow path from the burn chamber into the engine.

7. The gasifier of claim 6 further comprising particulate removal apparatus in the flow path between the intake and burn chamber outlet conduit.

8. The gasifier of claim 1 in which:

the burn chamber is formed of an upper chamber and a lower chamber below the upper chamber;

the upper chamber is separated from the lower chamber by a hinged plate; and the hinged plate is operable upon hinging to transfer feed material under force of gravity from the upper chamber into the lower chamber.

9. The gasifier of claim 1 further comprising reciprocating angled plates interleaved with the plates of the grate, the reciprocating angled plates being ranged to reciprocate parallel to the downstream direction and cause debris on the grate to move towards the encircling wall.

10. The gasifier of claim 5 farther comprising ports in the encircling wall adjacent the grate for the removal of debris from the burn chamber.

11. The gasifier of claim 1 in which the water supply is a source of steam.

12. The gasifier of claim 11 in which the source of steam is a coiled pipe encircling the burn chamber.

13. The gasifier of claim 1 in which the gas supply is connected to a source of heated air.

14. The gasifier of claim 7 in which the particulate removal apparatus is selected from the group consisting of scrubbers and filters.

15. The gasifier of claim 1 in which the flow path passes above a water reservoir.

16. The gasifier of claim 15 in which the bum chamber is bounded on one side by water in the water reservoir.

17. The gasifier of claim 15 in which the burn chamber outlet conduit comprises a pipe having an opening for entry of gas into the pipe, the opening being on a side of the pipe that faces the water in the water reservoir.

18. A gasifier, comprising:

a feed hopper;

a burn chamber disposed to receive feed material from the feed hopper, the burn chamber having a combustion zone;

a gas supply operably connected to the burn chamber for supplying gas containing oxygen to the burn chamber;

a water supply operably connected to the burn chamber for supplying water to the burn chamber;

a burn chamber outlet conduit in the burn chamber below the combustion zone for egress of gases produced within the burn chamber by reaction of pyrolysis products to produce fuel gases;

the burn chamber and the burn chamber outlet conduit together defining a flow path for gas flowing out of the burn chamber;

the flow path passing above a water reservoir with the burn chamber being bounded on one side by water in the water reservoir; and the burn chamber outlet conduit comprising a pipe having an opening for entry of gas into the pipe, the opening being on a side of the pipe that faces the water in the water reservoir.

19. A gasifier, comprising:

a feed hopper;

a bum chamber disposed to receive feed material from the feed hopper, the burn chamber having a combustion zone;

a gas supply operably connected to the burn chamber for supplying gas containing oxygen to the burn chamber;

a water supply operably connected to the burn chamber for supplying water to the bum chamber;

a burn chamber outlet conduit in the burn chamber below the combustion zone for egress of gas produced within the burn chamber by reaction of pyrolysis products to produce fuel gases;

an evacuator connected to the burn chamber outlet conduit for drawing gas from the burn chamber along a flow path; and the burn chamber being formed of an upper chamber and a lower chamber below the upper chamber;

the upper chamber being separated from the lower chamber by a hinged plate; and the hinged plate being operable upon hinging to transfer feed material tinder force of gravity from the upper chamber into the lower chamber.

20. A gasifier, comprising:

a feed hopper;

a burn chamber disposed to receive feed material from the feed hopper, the burn chamber having a combustion zone;

a gas supply operably connected to the burn chamber for supplying gas containing oxygen to the burn chamber;

a water supply operably connected to the burn chamber for supplying water to the burn chamber;

a burn chamber outlet conduit in the burn chamber below the combustion zone for egress of gas produced within the burn chamber by reaction of pyrolysis products to produce fuel gases;

an evacuator connected to the burn chamber outlet conduit for drawing gas from the burn chamber along a flow path; and particulate removal apparatus in the flow path between the intake and burn chamber outlet conduit, the particulate removal apparatus being selected from the group consisting of scrubbers and filters.

21. The gasifier of claim 20 in which the flow path passes above a water reservoir.

22. The gasifier of claim 21 in which the burn chamber is bounded on one side by water m the water reservoir.

23. The gasifier of claim 22 in which the burn chamber outlet conduit comprises a pipe having an opening for entry of gas into the pipe, the opening being on a side of the pipe that faces the water in the water reservoir.

* * * * *